US005884802A

United States Patent [19]

Leibowitz

[11] Patent Number: 5,884,802

[45] Date of Patent: Mar. 23, 1999

[54] ERGONOMIC FLUID CONTAINER

[76] Inventor: Alissa Leibowitz, 750-92 Lido Blvd., Lido Beach, N.Y. 11561

[21] Appl. No.: 254,973

[22] Filed: Jun. 7, 1994

[51] Int. Cl.[6] ..... B67D 5/60

[52] U.S. Cl. ..... 220/771; 222/465; 222/465.1

[58] Field of Search ..... 222/465, 465.1; 220/752, 771

[56] References Cited

U.S. PATENT DOCUMENTS

| | | | |
|---|---|---|---|
| D. 92,518 | 6/1934 | Briner . | |
| D. 216,248 | 12/1969 | Hills . | |
| D. 221,517 | 8/1971 | Luedtke . | |
| D. 224,200 | 7/1972 | Kretz . | |
| D. 273,276 | 4/1984 | Klim . | |
| 595,414 | 12/1897 | Roach . | |
| 3,137,415 | 6/1964 | Faunce . | |
| 3,250,434 | 5/1966 | Howlett | 220/465 |
| 3,443,710 | 5/1969 | Hills . | |
| 3,765,574 | 10/1973 | Urquiza . | |
| 3,841,528 | 10/1974 | Eisenberg . | |
| 4,327,861 | 5/1982 | Thompson . | |
| 4,334,942 | 6/1982 | Thompson . | |
| 4,372,737 | 2/1983 | Thompson . | |
| 4,376,509 | 3/1983 | Schaffer . | |
| 4,446,986 | 5/1984 | Bowen et al. . | |
| 4,676,385 | 6/1987 | Zimmerman . | |
| 4,691,828 | 9/1987 | Slusarczyk et al. . | |
| 4,733,804 | 3/1988 | Slat et al. . | |
| 4,781,314 | 11/1988 | Schoonover et al. . | |
| 4,804,134 | 2/1989 | Reil . | |
| 4,811,870 | 3/1989 | Bianco . | |
| 4,819,833 | 4/1989 | Huddleston et al. | 222/465.1 |
| 4,860,927 | 8/1989 | Grindle | 222/465.1 |
| 4,895,298 | 1/1990 | Reil . | |
| 4,923,098 | 5/1990 | Schoonover et al. . | |
| 4,972,972 | 11/1990 | Goguen | 222/465.1 |
| 5,226,574 | 7/1993 | Durinzi, Jr. | 222/465.1 |

*Primary Examiner*—Joseph M. Moy
*Attorney, Agent, or Firm*—Fish & Richardson P.C.

[57] ABSTRACT

An ergonomic fluid container which can stably support itself on a surface in either a horizontal or vertical orientation is described. A hollow handle portion is located approximate to the center of gravity of the container and is designed to permit a wide variety of individuals to obtain a complete hand grip. The container also comprises an angled spout and one or more rounded edges that may be used to roll the container on the surface to facilitate pouring.

7 Claims, 4 Drawing Sheets

ERGONOMIC FLUID CONTAINER

FIELD OF THE INVENTION

This invention relates to an improved fluid container for edible liquids such as milk, juice, mineral water and oils, and for non-edible liquids such as liquid bleach and detergents. In particular, the container is ergonomically designed to facilitate pouring, and can stably support itself in either of two positions.

BACKGROUND OF THE INVENTION

Several types of mass-marketed fluid containers are known. For example, half-gallon cardboard milk containers and plastic juice containers are commonplace in supermarkets. Such containers are used by consumers on a daily basis and therefore should be designed for ease of use. However, cardboard milk containers generally lack a handle, making half-gallon and larger sizes unwieldy and difficult to pour. In addition, the average vertically-standing cardboard container offers insufficient resistance and rigidity under load conditions which can result in breakage during handling. This characteristic also tends to make these containers unstable when stacked on top of one another.

Plastic containers typically have handles, but are not designed for ease of use. For example, U.S. Pat. No. 4,733,804 discloses a plastic liquid dispensing container having a handle and a ribbed construction. The spout and the handle are located on the top side of the container and are parallel to the top closure portion. The positions of the handle and spout make a described two and one-half gallon embodiment difficult to pour.

Thus, present day commercially available cardboard and plastic containers are inadequate because a large part of the population, especially the very young and the elderly, cannot easily manipulate them.

SUMMARY OF THE INVENTION

The present invention utilizes ergonomics, which is the science of fitting products, tools and workplaces to the people who use them, to provide a liquid container that is comfortable to use, and thus puts less wear and tear on the human body.

Another object of the present invention is to provide a container which can stand horizontally or vertically, and which can be easily poured from either position.

An ergonomic container for holding fluids according to the invention has a generally rectangular, hollow body having a U-shaped top section, first and second side walls, a bottom wall, a front wall and a rear wall. The bottom wall and the rear wall are perpendicular to each other and have generally planar surfaces such that the container can stably support itself on either of the rear or bottom walls. A hollow handle portion is connected to the top section and is adjacent to the center of gravity of a full container. Lastly, an angled spout for dispensing a liquid is located at the juncture between the top section and the front wall.

In a preferred embodiment, the handle portion is designed to permit a majority of diverse individuals to obtain a full grip on the container. In addition, the handle is located near the center of gravity to make it easier to balance a liquid-filled container. Further, the angled spout facilitates pouring because the container can be tilted by an individual about an edge contacting a surface to aid in the dispensing of liquid.

Further objects, features and advantages of the present invention are readily apparent from the following detailed description when taken in connection with the accompanying drawings.

DETAILED DESCRIPTION

Figure 1:
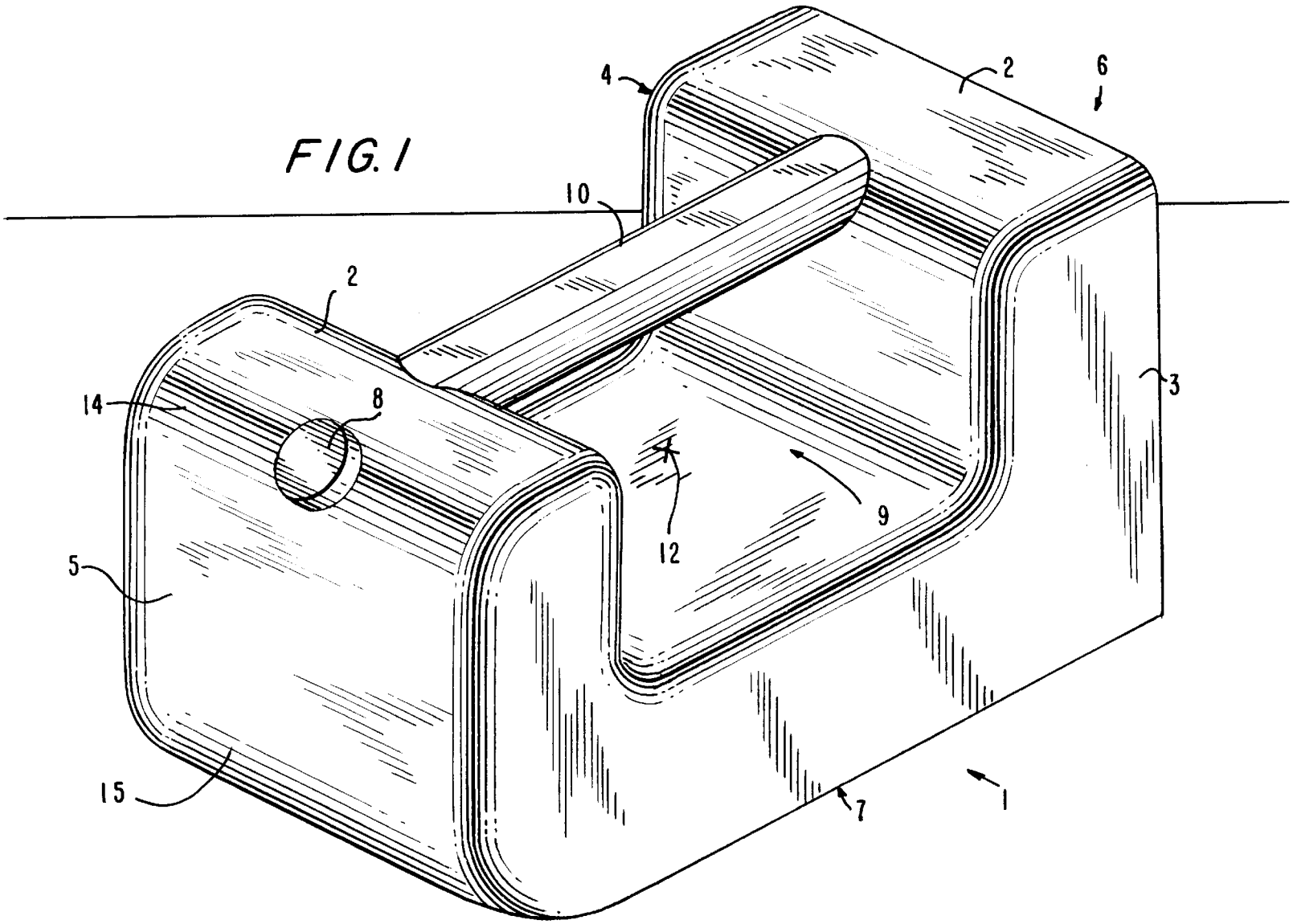
FIG. 1 is a three-quarter side perspective view of a fluid container according to the present invention shown resting on a surface in its horizontal position.

FIG. 1 is a three-quarter side perspective view of a fluid container 1 according to the present invention having a hollow body for storing fluids. The container 1 comprises a U-shaped top section 2, a first side wall 3, a second side wall 4, a front wall 5, a generally planar rear wall 6, a generally planar bottom wall 7, a hollow handle 10 and a spout 8. The front wall 5 has a first rounded edge 14 and a second rounded edge 15, and the bottom wall 7 is perpendicular to the rear wall 6. The angled dispensing spout 8 is located approximately in the middle of the first rounded edge 14 where the top section 2 and front wall 5 are joined.

It should be understood that although most of the edges between the walls shown in FIG. 1 are rounded, other edge-types such as beveled edges may be utilized. In addition, only the surfaces of rear wall 6 and bottom wall 7 are required to be generally planar; the other walls may be convexly rounded.

Referring again to FIG. 1, the hollow handle 10 is connected from one side of the U-shaped top section 2 to the other, as shown, and fluid is permitted to flow through it. The handle 10 is also adjacent to the center of gravity 12 of a full container, represented by an "x" in FIGS. 1 and 4. The center of gravity 12 of a full container lies in the open-air cavity 9 (more easily seen in FIG. 3) formed by the handle 10 and U-shaped top section 2 as shown, which also lies mid-way between the first side wall 3 and second side wall 4.

Figure 2:
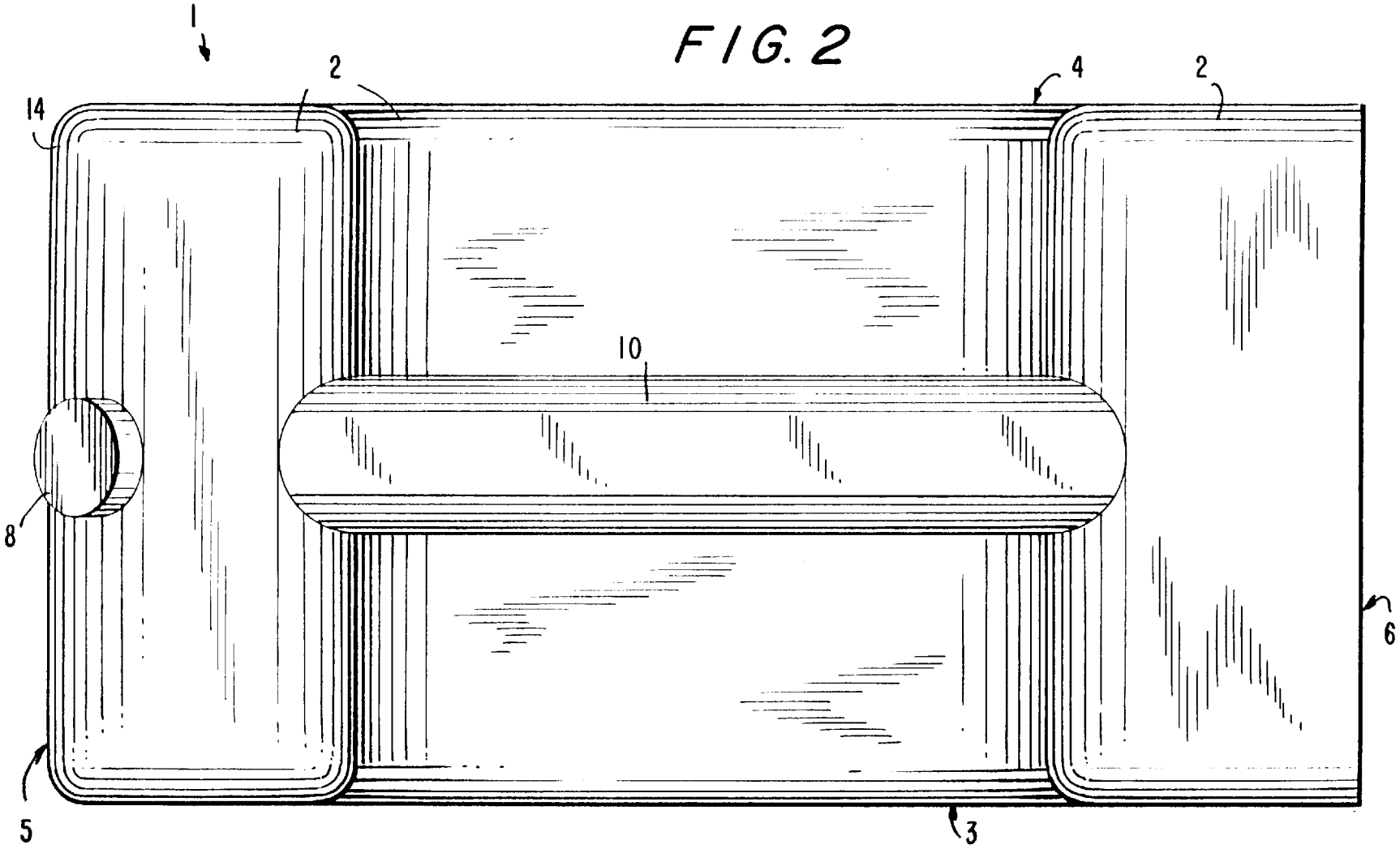
FIG. 2 is a top view of the fluid container of FIG. 1.

FIG. 2 is a top view of the liquid container 1 of FIG. 1, and is to be understood that like components are numbered the same in all the figures. As shown in FIG. 2, the handle portion 10 is connected from one end of the U-shaped top section 2 to the other, and is located approximately half-way between the front wall 5 and rear wall 6. The handle 10 is also approximately in the middle of the side walls 3 and 4. The dispensing spout 8 is located on the first rounded edge 14, and is preferably angled at approximately 45 degrees measured in relation to the bottom wall 7 (shown in FIG. 1). The spout 8 may be fitted with a screw-threaded cap (not shown) or the like, which can be removed and later replaced in a known manner. Similarly, other types of removably-attached caps, such as snap-off caps, could be used.

In order to pour a liquid from the container 1 when it is resting on a surface in the horizontal position shown in FIG. 1, an individual may grasp the handle portion 10 and lift the rear part of bottom wall 7 off of the surface so that the container rotates about the second rounded edge 15 which is contacting the surface. This feature permits the elderly and very young, who otherwise would have difficulty lifting, balancing and pouring a liquid-filled container, to easily manipulate the container.

Figure 3:
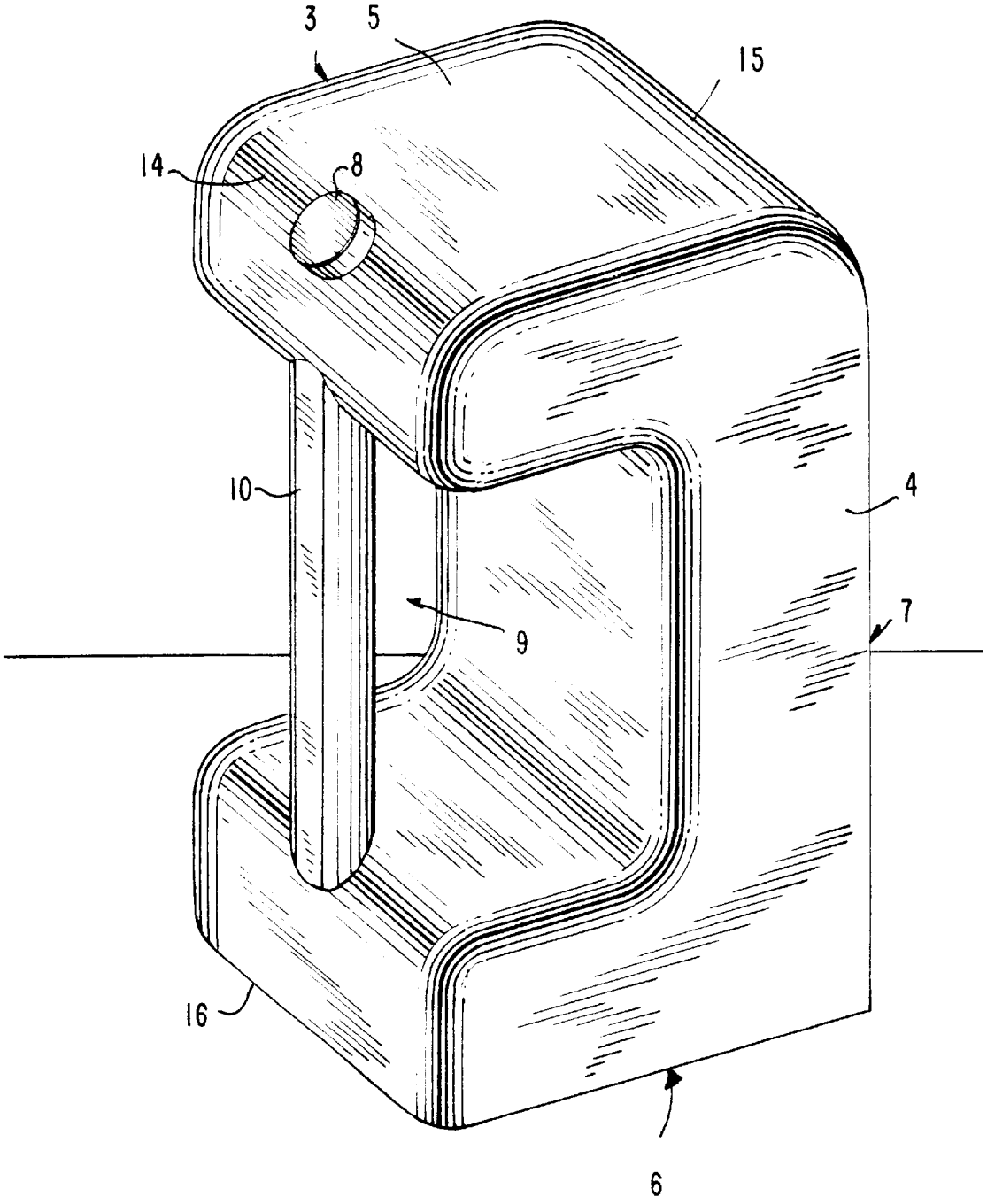
FIG. 3 is a three-quarter side view of the container of FIG. 1 shown standing on a surface in its vertical position.

FIG. 3 is a three-quarter side view of the container 1 of FIG. 1 shown standing in its vertical position on a surface on rear wall 6. It is contemplated that this vertical orientation will be used primarily for storage purposes because the container then uses less shelf space, for example, in a home refrigerator. In addition, a container according to the invention would likely be displayed in stores in this orientation, and thus existing store display areas would not have to be redesigned.

In order to pour a liquid from a container 1 standing in its vertical position as shown in FIG. 3, a person could grasp the container with both hands from the side nearest bottom wall 7, so that her fingers reach around the side walls 3 and 4. A third edge 16 can then be used to balance the container on a countertop while pouring.

Figure 4:
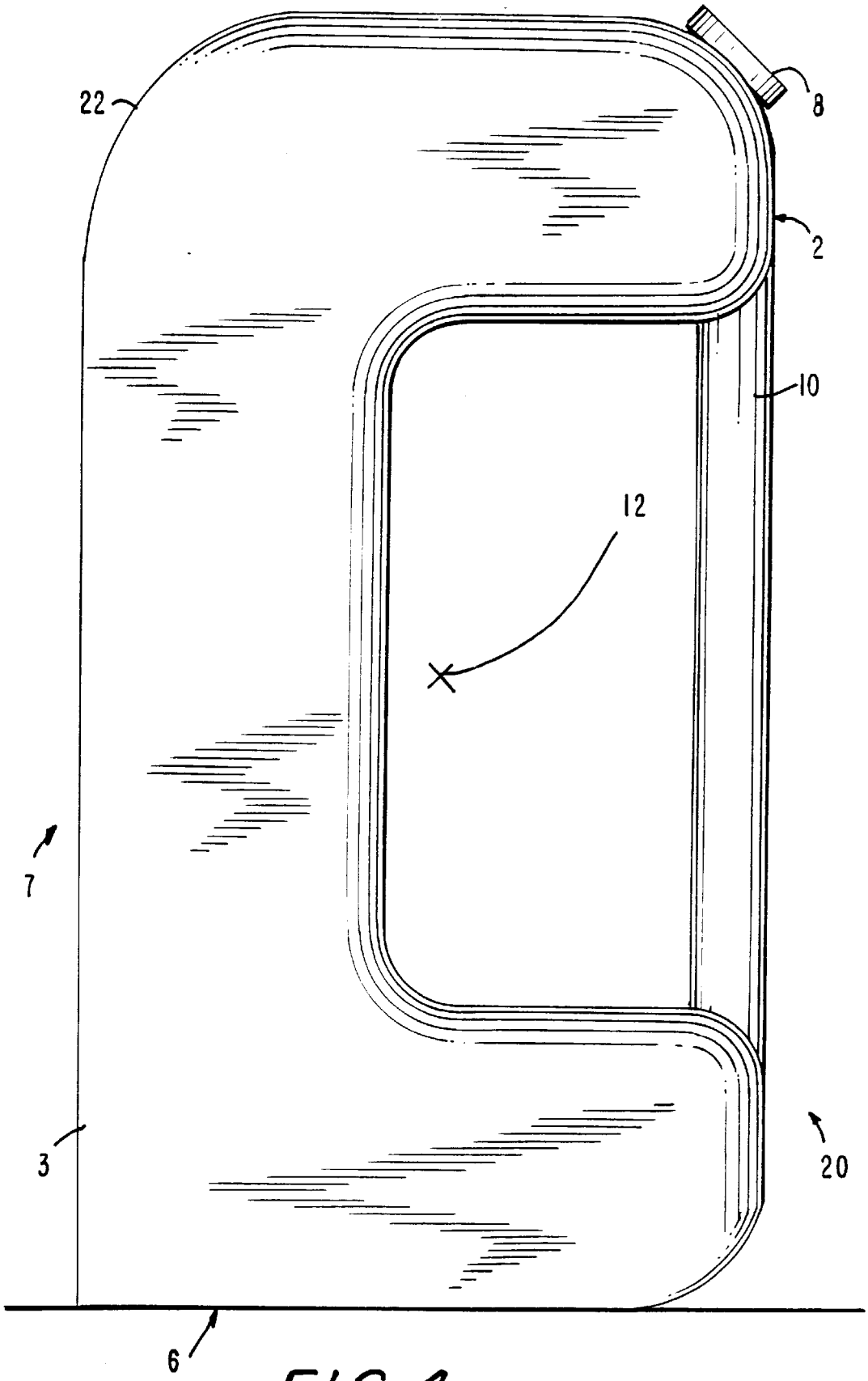
FIG. 4 is a side view of another embodiment of the present invention shown standing on a surface in its vertical position.

FIG. 4 is a side view of a fluid container 20 according to another embodiment of the present invention, shown standing vertically on its rear wall 6. The container 20 has a third rounded edge 24 which may be used to facilitate pouring. In particular, an individual may grasp the container with both hands from the side nearest the bottom wall 7, wrapping her fingers around side walls 3 and 4, and then tilt the container to roll the container on the surface about the third rounded edge 24 to pour. Alternately, a user could grasp the handle 10 and rotate the container 20 about third rounded edge 24 to pour liquid into a cup, for example.

The container 20 of FIG. 4 also has an enhanced rounded edge 22 having a more pronounced curvature than the rounded edge 15 shown in the container of FIG. 1. The enhanced rounded edge 22 can be used to facilitate pouring when the container is resting on a surface in its horizontal position on bottom wall 7. In particular, a person could grasp handle 10 and roll the container on the surface about the enhanced rounded edge 22, as the rear portion 6 is lifted upward away from the surface, to pour.

A preferred embodiment of a container according to the invention has a liquid capacity of approximately one-half gallon, but may hold from approximately one quart to one gallon of fluid. In addition, the container is preferably made from biodegradable plastic, which is environmentally sound, lightweight, and can be molded into a container having rounded edges.

The ergonomic container depicted in FIGS. 1 to 4 is designed to be comfortable and easy to use by consumers. A prototype was created using data of women's hand dimensions collected in increments of third, fifth, fiftieth, ninety-fifth and ninety-eighth percentiles of the population. Palm length, middle finger length, hand length, little finger length, maximum grip diameter and hand breadth measurements were analyzed and then used to design the handle portion to allow a diverse mix of individuals to acquire a complete hand grip. The handle portion also was placed as close to the center of gravity of a full container as possible so that a person could more easily balance a liquid-filled container.

In summary, a container according to the present invention has a double base, so that it may stand either horizontally or vertically. Further, the handle portion is close to the center of gravity of a full container and permits a user to retain a complete hand grip while manipulating the container. In addition, the second and third rounded edges of the container described above permit a person to roll the container about a surface when the container is in either of its horizontal or vertical positions, to balance the weight of the container during pouring. Thus, the invention is particularly useful for the very young and for the elderly who often have difficulty manipulating half gallon and larger capacity containers.

While a preferred embodiment of the present invention has been described in detail, those of skill in the art will recognize that various modifications, alternative designs and embodiments can be made that are within the scope of the invention, as defined by the following claims.

I claim:

1. An ergonomic container for fluids, comprising:

a generally rectangular, hollow body having a U-shaped top section, a first side wall, a second side wall, a front wall and a rear wall, wherein the bottom and rear walls are perpendicular to each other and have generally planar surfaces such that the container can stably support itself in either a horizontal or vertical orientation;

a first rounded edge between the front wall and the top section;

a second rounded edge having an enhanced curvature located between the front wall and the bottom wall;

an angled spout located on the first rounded edge; and a hollow handle portion connected to the U-shaped top such that it is approximately half-way between the front and rear walls, half-way between the first and second side walls and near the center of gravity of a full container, wherein liquid may flow through the hollow handle portion and wherein the size of the handle permits a diverse mix of individuals to acquire a complete hand grip;

and wherein when the bottom of the container is restainer is on a surface a user may pour liquid by grasping the handle and rolling the container about the second rounded edge in contact with surface.

2. The apparatus of claim 1, wherein the angle of the spout measured in relation to the bottom wall is approximately 45 degrees.

3. The apparatus of claim 1, wherein the spout is located approximately in the middle of the first rounded edge.

4. The apparatus of claim 1, further comprising:

a third rounded edge between the top section and the rear wall of the container to facilitate pouring when the container is in its vertical orientation.

5. The apparatus of claim 1, wherein the top section of the container is convexly rounded.

6. The apparatus of claim 1, wherein the first and second side walls are convexly rounded.

7. The apparatus of claim 1, wherein the container is made of biodegradable plastic.

* * * * *